US005163566A

United States Patent [19]

Hempel

[11] Patent Number: 5,163,566

[45] Date of Patent: Nov. 17, 1992

[54] HYGIENIC MAGNETIC TOOTHBRUSH HOLDER

[76] Inventor: Jeffrey D. Hempel, 33710 Santiago Rd., Acton, Calif. 93510

[21] Appl. No.: 797,297

[22] Filed: Nov. 25, 1991

[51] Int. Cl.[5] ..... A47F 5/00

[52] U.S. Cl. ..... 211/65; 211/DIG. 1; 248/110; 248/205.3; 248/309.4

[58] Field of Search ..... 211/65, 66, DIG. 1; 248/110, 205.3, 20.5, 309.4; D6/528, 534

[56] References Cited

U.S. PATENT DOCUMENTS

| | | | |
|---|---|---|---|
| 2,414,653 | 1/1947 | Lockholder | 175/367 |
| 2,642,999 | 6/1953 | McPherson | 211/65 |
| 2,798,241 | 7/1957 | Cohen | 15/143 |
| 3,109,619 | 11/1963 | Krug et al. | 248/110 X |
| 3,782,799 | 1/1974 | Hansen | 312/206 |
| 3,794,181 | 2/1974 | Canham | 248/205.3 X |
| 3,946,877 | 3/1976 | Galicia | 248/205.3 X |
| 4,523,599 | 6/1985 | Collet | 211/65 X |

FOREIGN PATENT DOCUMENTS

| | | | |
|---|---|---|---|
| 755351 | 8/1956 | United Kingdom | 211/65 |

*Primary Examiner*—Robert W. Gibson, Jr.

*Attorney, Agent, or Firm*—Poms, Smith, Lande & Rose

[57] ABSTRACT

A hygienic magnetic toothbrush mounting system is disclosed. The system includes a mounting member and at least one toothbrush. The toothbrush has a small thin sheet metal element of non-corrosive magnetic material secured to the back of the toothbrush handle. The mounting member is formed of translucent plastic and includes at least one recess for receiving the toothbrush. Each recess has a small, high strength permanent magnet secured into the mounting member such that the outer surface of the magnet is flush with the bottom of the recess. The recess is shaped to position the toothbrush laterally and vertically within the recess. The translucent configuration of the mounting member and the relatively small configuration of the permanent magnet and the sheet metal element permit easy visual inspection of said system to insure hygienic cleanliness of the system.

19 Claims, 2 Drawing Sheets

FIG. 1
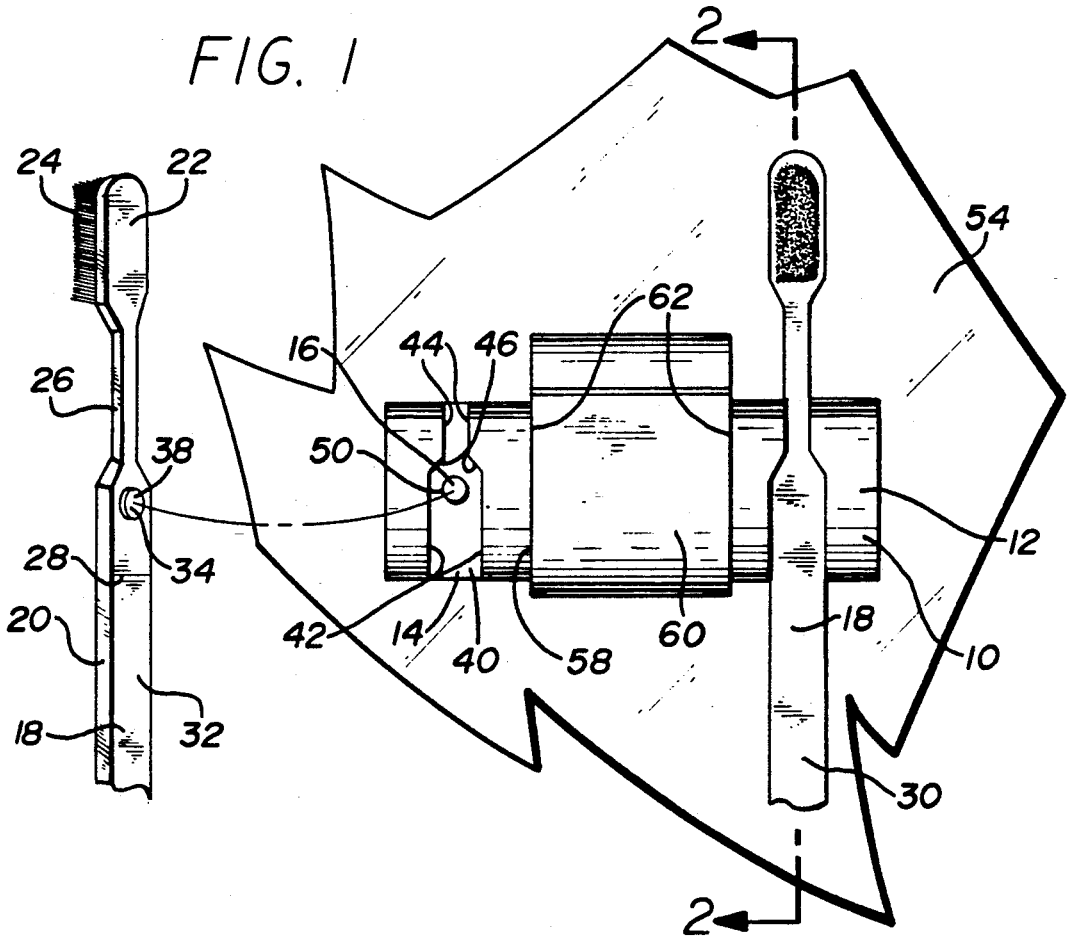
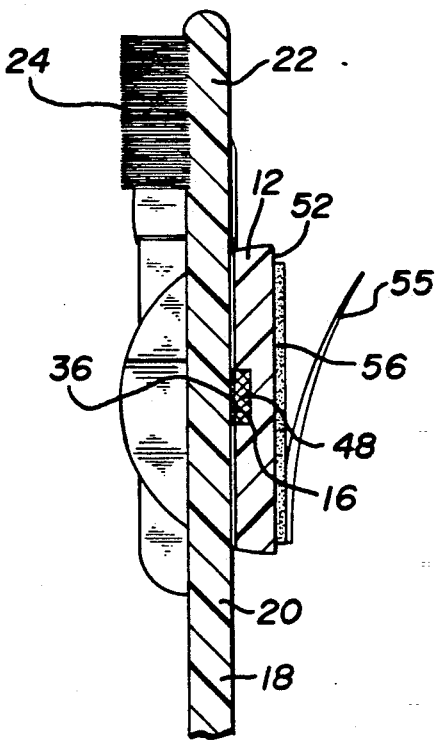
FIG. 2

FIG. 3
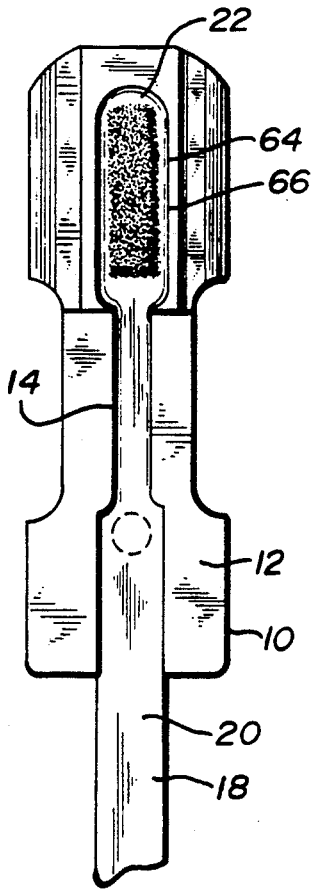
FIG. 4
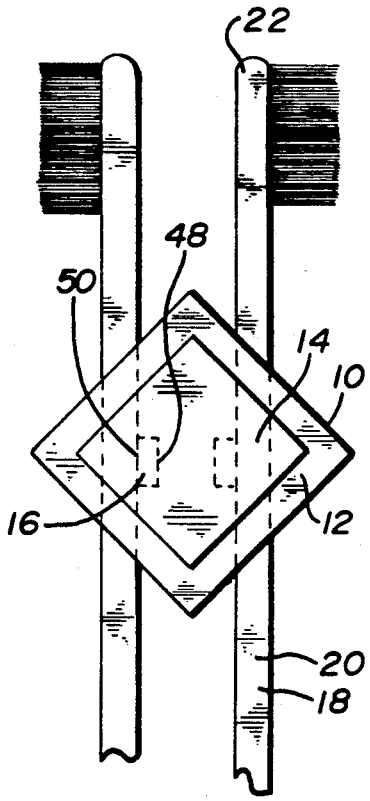
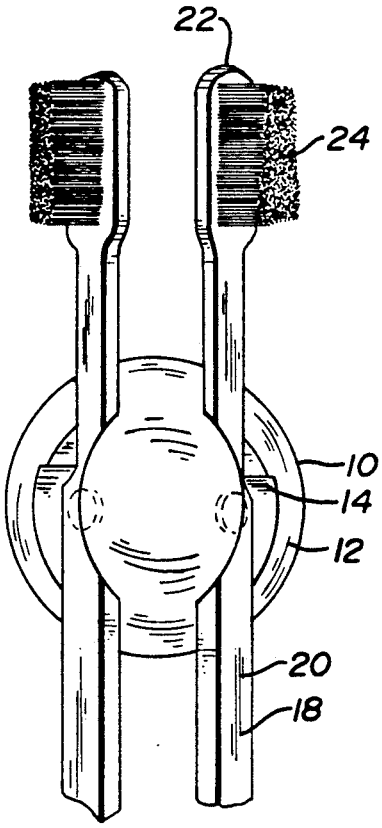
FIG. 5

HYGIENIC MAGNETIC TOOTHBRUSH HOLDER

FIELD OF INVENTION

This invention relates to toothbrush holders and more particularly to toothbrush holders using magnetic attraction to hold the toothbrush in the holder.

BACKGROUND OF INVENTION

In the past, various types of toothbrush holders have been used for storing toothbrushes when not in use. The holders include cup-type holders, and other types of holders that are mounted to a bathroom wall. However, a recurring problem with the known toothbrush holders is their inability to maintain the toothbrush in the hygienic manner desired for a toothbrush.

For example, the wall mounted toothbrush holders typically include apertures wherein the handle portion of the toothbrush is inserted into the holder, and the bristles of the toothbrush rest on the holder, preventing the toothbrush from falling through the apertures. The problem with this type of holder is that the bristles are forced to contact the holder when the toothbrush is not in use. Because the toothbrush is inserted into the holder while the bristles are still wet, bacteria and contaminants tend to develop in the area of the holder surrounding the bristles. Therefore, the toothbrush is not stored in a hygienic manner.

Other types of toothbrush storage, such as devices which encapsulate the bristles of the toothbrush, prevent ventilation through the bristles. As a result, the toothbrush bristles do not completely dry between uses, and the bristles are subject to the growth of bacteria.

Toothbrush storage systems have been designed which utilize magnetic attraction to store the toothbrush in a manner in which the bristles do not contact any other surface when the toothbrush is not in use. For example, U.S. Pat. No. 3,782,799, issued to H. H. Hansen on Jan. 1, 1974 discloses a magnetic toothbrush holder that includes a permanent magnetic wheel. Each toothbrush has a steel block imbedded in the handle that attracts to the magnetic wheel. U.S. Pat. No. 2,414,653, issued to A. E. Lockholder on Jan. 21, 1947, discloses a magnetic toothbrush holder that utilizes a U-shaped or bar-shaped magnet secured to a wall. An elongated iron insert is disposed within the handle in order to magnetically attract and position itself to the holder magnet.

Another type of magnetic toothbrush holder is disclosed in U.S. Pat. No. 2,642,999, issued to J. C. McPherson on Jun. 23, 1953. McPherson discloses a magnetic holding device utilizing a magnet with a ring portion, a central disk-shaped portion, and connecting portions extending from the ring portion to the central portion. The magnet is embedded in a bracket, which is secured to a wall surface. The magnet is thus able to attract and hold toothbrushes and shaving brushes, as well as to support a cup on the upper surface of the bracket. U.S. Pat. No. 2,798,241, issued to T. Cohen on Jul. 9, 1957 discloses a magnet-carrying toothbrush, wherein a bar magnet is attached to or disposed within the toothbrush handle.

However, one problem with the known magnetic toothbrush holders is that the toothbrush is not secured laterally or vertically in position, but is merely attracted to a magnet. If the toothbrush is disturbed, the holders do not have any means of preventing lateral or vertical movement of the toothbrush. As a result, the toothbrush can either be shifted into contact with an unclean surface, or dislodged completely out of contact with the magnet and out of the holder. Moreover, with the known magnetic toothbrush holders, the user must carefully place the magnetic portion of the toothbrush in contact with the magnetic portion of the holder, because the holders do not have a positioning guide.

Another problem with the known magnetic toothbrush holders is that they are primarily constructed from metallic material. Therefore, it is difficult to ascertain when the material is contaminated, and when the holder requires cleaning.

The known magnetic toothbrush holders require relatively large magnets to provide the magnetic strength required to hold the toothbrush in place. As a result, the toothbrush holders are heavy and relatively difficult to mount on a wall surface without a mounting bracket or other hardware. The required mounting hardware discourages the installation of the toothbrush holders on ceramic tile or bathroom mirrors. Large elements of magnetic material are also included on the toothbrushes, requiring special fabrication, or covering substantial areas on the toothbrush.

Therefore, a need exists for a lightweight hygienic toothbrush holder that attracts the toothbrushes to the holder, prevents the lateral and vertical movement of the toothbrushes, and permits easy visual inspection and cleaning of the holder.

SUMMARY OF INVENTION

One object of the present invention is to provide a toothbrush holder that permits easy visual inspection of the holder and toothbrush.

Another object of this invention is to provide a toothbrush holder that allows hygienic storage of toothbrushes.

A further object of the present invention is to provide a toothbrush holder that positions the toothbrush laterally and vertically within the holder.

Yet another object of the present invention is to provide a toothbrush holder that allows easy removal and replacement of the toothbrush in the holder.

A still further object of the invention is to provide a toothbrush holder that also is capable of storing other dental products.

Another object of the invention is to provide a toothbrush holder that is lightweight and easily mounted on a bathroom surface such as tiles or a mirror.

These and other objects of the present invention are achieved through a hygienic toothbrush holder comprising a main mounting member formed of translucent plastic, wherein the mounting member includes at least one toothbrush-receiving recess that restrains the toothbrush against lateral movement, and vertically positions the toothbrush in the holder. The mounting member has a small high-strength permanent magnet corresponding to each recess and secured into the recess with the magnet outer surface substantially flush with the bottom of the recess. The toothbrush has dimensions that fit into the recess, and has a small, thin sheet metal element of magnetic material secured to the toothbrush on a predetermined area facing the permanent magnet.

Advantages of the present invention include the ready visual inspection of the holder and brushes to insure cleanliness. With the toothbrushes being located both laterally and vertically, very small, accurately positioned permanent magnets may be used on the holder, and small plated steel elements may be surface bonded to the toothbrushes, so that commercially available toothbrushes may be used, and the magnets do not significantly obstruct visual inspection of the unit.

These and other objects of the present invention will now become apparent from a review of the drawings and the following description of the preferred embodiments.

BRIEF DESCRIPTION OF THE DRAWINGS

FIG. 1 is a front view of a first embodiment of the toothbrush holder illustrating the principles of this invention attached to a surface and showing one toothbrush held in position on the holder and another toothbrush out of the holder;

FIG. 2 is a side sectional view of the toothbrush holder taken along line 2—2 of FIG. 1;

FIG. 3 is a front view of a second embodiment of a toothbrush holder;

FIG. 4 is a front view of a third embodiment of a toothbrush holder; and

FIG. 5 is a front view of a fourth embodiment of a toothbrush holder.

DETAILED DESCRIPTION OF PREFERRED EMBODIMENT

Referring now to FIG. 1, a first embodiment of the toothbrush holder 10 of the present invention is shown. The holder 10 primarily comprises a main mounting member 12, a plurality of toothbrush recesses 14 defined by the mounting member 12, and a plurality of permanent magnets 16, each permanent magnet corresponding to one of the recesses 14. FIG. 1 also shows a plurality of toothbrushes 18. Each of the toothbrushes 18 has standard toothbrush dimensions and includes a handle 20, a head 22, and a plurality of bristles 24. The handle 20 has a narrow portion 26 adjacent and extending from the head 22, and a wider portion 28 extending from the narrow portion 26. The handle 20 also has a front surface 30 and a back surface 32, wherein the front surface 30 corresponds to the surface of the toothbrush having the bristles 24.

Each toothbrush 18 has a small magnetic member 34. The magnetic member 34 preferably has a first surface 36 and a second surface 38. The members 34 are preferably circular. The magnetic member 34 may be formed from a thin sheet of magnetic material preferably less than twenty thousandths of an inch thick, in the order of ten thousandths of an inch, for example. The thin sheet of magnetic material may be comprised of regular thin sheet steel plated with either nickel or chromium. Because of the thinness of the magnetic member 34 when the first surface 36 of the magnetic member 34 is secured to the wider portion 28 of the back surface 32 of the toothbrush handle 20, the second surface 38 of the magnetic member 34 is substantially flush with the toothbrush back surface 32. It should be noted, however, that in other embodiments of the present invention, it may be advantageous to secure the magnetic member 34 to another area of the back surface 32 of the toothbrush handle 20, or to secure the magnetic member 34 to the front surface 30 of the toothbrush handle 20.

Referring now to both FIG. 1 and FIG. 2, the main mounting member 12 is described in detail. In the first embodiment shown, the mounting member 12 has two toothbrush recesses 14, with one of the permanent magnets 16 embedded in the member 12 immediately below each recess 14. In the preferred embodiment of the holder 10, each recess is defined by a bottom surface 40, a pair of wide vertical walls 42, a pair of narrow vertical walls 44, and a pair of lateral walls 46. When the toothbrush 18 is stored in the holder 10, the toothbrush handle back surface 32 contacts the recess bottom surface 40. The wide vertical walls 42 are dimensioned such that the wide portion 28 of the toothbrush handle 20 easily fits between the wide vertical walls 42. The narrow vertical walls 44 are dimensioned such that the toothbrush handle narrow portion 26 easily fits between the narrow vertical walls 44. Therefore, when the toothbrush handle back surface 32 is in contact with the recess bottom surface 40, the wide vertical walls 42 and the narrow vertical walls 44 serve to restrain the toothbrush 18 from lateral movement. The slanted lateral wall sections 46 connect the wide vertical walls 42 and the narrow vertical walls 44. When the toothbrush handle back surface 32 is in contact with the recess bottom surface 40, and the toothbrush is inserted and shifted upwardly, the lateral walls 46 serve to restrain the toothbrush 18 from further upward or vertical movement. The wide vertical walls 42, narrow vertical walls 44 and lateral walls 46 also serve to guide the toothbrush 18 into its proper position by preventing the placement of the magnetic member 34 toothbrush 18 either off center or above the permanent magnet 16 in the recess 14.

The permanent magnets 16 have first surface 48 and second surface 50 and are preferably circular. The permanent magnets 16 are preferably secured into the mounting member 12 such that the permanent second surface 50 is substantially flush with the recess bottom surface 40. The permanent magnets may be press-fit into openings in the member 12, and may be supplementally secured by suitable glue or adhesive. The magnetic members 34 may be glued to the toothbrushes in the proper location, and may, if desired be secured into their surfaces. The permanent magnets 16 preferably have a transverse diameter slightly smaller than the transverse diameter of the toothbrush magnetic member 34.

The permanent magnets 16 are preferably rare earth magnets, and more specifically may be Samarium Cobalt (SmCo) magnets. The SmCo magnets have high magnetic strength, and thus allow for the use of a smaller magnet than required for an Alnico or other Ceramic type magnet. The SmCo magnets also have good corrosion resistance properties, and thus are well-suited for use in the toothbrush holder 10 of the present invention.

For completeness, the transverse diameters of the permanent magnet 16 and the toothbrush magnetic member 34 are given. It is to be understood, however, that these dimensions are exemplary only. The permanent magnet 16 preferably has a transverse diameter of one-quarter of an inch. The toothbrush magnetic member 34 preferably has a transverse diameter of five-sixteenths of an inch. Therefore, it is shown that the toothbrush magnetic member 34 preferably has a transverse diameter that is substantially equal to or slightly larger than the transverse diameter of the permanent magnet 16. In view of the transverse and vertical location of the toothbrush, the magnets 16 and elements 34 may be small, and are accurately located.

The mounting member 12 has a substantially planar mounting surface 52 for securing the toothbrush holder 10 to a flat surface 54. The mounting surface 52 preferably includes a layer of adhesive 56 to allow the mounting member 12 to easily and quickly adhere to a mirror, plaster wall, ceramic tile wall, or any other type of substantially flat surface. FIG. 2 shows the use of pressure-sensitive adhesive for the adhesive layer 56. In order to mount the holder 10 to a wall with the pressure sensitive adhesive, a backing sheet 55 is peeled away, and the mounting member mounting surface 52 is pressed in contact with the flat surface 54. The backing sheet 55 is normally provided with a release coating such as silicone, to facilitate its removal. Alternatively, at least one suction cup may be attached to the mounting surface 52 such that the suction cup attaches to the bathroom wall or flat surface for mounting the holder.

The mounting member 12 is preferably constructed from a translucent material. The translucency allows easy visual inspection of the mounting member in order to determine if the mounting member requires cleaning for hygienic purposes. The translucency further provides aesthetic features to the holder. The mounting member 12 may also be constructed of a transparent material. The adhesion member 56 is also preferably translucent in order to maintain the easy visual inspection of the holder 10.

The mounting member 12 is also preferably constructed from a relatively hard plastic material. The plastic material ensures durability of the holder 10, and provides for a lightweight holder that easily adheres to a planar surface without the weight of the holder pulling the holder off the wall.

Referring to FIG. 1, the first embodiment of the holder 10 shown further includes a second recess 58 for holding a dental floss container 60. The dental floss container 60 has a container back surface (not shown) to which the first surface 36 of the magnetic member 34 is secured. The second recess 58 is defined by a second recess bottom surface (not shown) and a set of second recess walls 62. The first surface 48 of the permanent magnet 16 is secured to the second recess bottom surface such that the permanent magnet second surface 50 is substantially flush with the second recess bottom surface. When the dental floss container back surface contacts the second recess back surface, the second recess vertical walls 62 restrain the dental floss container 60 from movement in the lateral direction. The dental floss container 60 may also be positioned vertically by the contacting of a transverse ridge on the dental floss container with the upper surface of the holder 10; or alternatively the holder 10 may be provided with an integral stop or flange above or below the container 60, to accurately locate the floss container 60 as the magnets apply retaining force.

The first embodiment of the present invention is shown with two recesses 14 for receiving toothbrushes 18, and one second recess 58 for receiving a dental floss container 60. The bottom surface of each of the recesses may be in the same plane.

Referring now to FIG. 3, a second embodiment of the toothbrush holder 10 of the present invention is shown. The second embodiment provides for a toothbrush holder 10 with one recess 14 for receiving one toothbrush 18. The recess 14 in the second embodiment of the toothbrush holder 10 includes a toothbrush head recess portion 64 defined by a head portion wall 66. The head portion wall 66 preferably approximates the shape of the toothbrush head 22, and prevents both lateral and vertical movement of the head 22 when the toothbrush 18 is held in place by the permanent magnet 16. The head portion wall 66 also preferably extends in height to the end of the bristles 24. Therefore, the head portion wall 66 serves to protect the bristles 24 from contamination, but permits the bristles to dry out by the open front of the holder.

Referring now to FIG. 4, a third embodiment of the toothbrush holder 10 of the present invention is shown. The third embodiment of the toothbrush holder 10 is square-shaped, and includes two recesses 14 for receiving toothbrushes 18. The planes formed by the bottom surface 40 of the recesses 14 are in a perpendicular relationship to each other.

Referring now to FIG. 5, a fourth embodiment of the toothbrush holder 10 of the present invention is shown. In the fourth embodiment, the mounting member 12 has a substantially hemispherical shape, with two recesses 14 in the hemisphere for receiving toothbrushes 18. The planes of the bottom surface 40 of the recesses 14 are in a substantially perpendicular relationship to each other.

Having thus described exemplary embodiments of the present invention, it should be noted by those skilled in the art that the within disclosures are exemplary only and that various other alternatives, adaptations and modifications may be made within the scope of the invention. Thus by way of example, but not of limitation, the mounting member 12 may include any number of toothbrush recesses 14 and second recesses 58 in various positions. Also the second recess 58 may receive other type of dental and bathroom accessories, as well as the dental floss container. Concerning the material used for the holders, it may be any transparent or translucent or other colored plastic, with relatively hard surface plastics such as acrylic plastic, being preferred. Further, the invention may be implemented using toothbrushes to which the magnetic elements 34 may be glued, bonded or secured by double stick adhesive tape, after manufacture of the toothbrushes; alternatively the elements 34 may be recessed into the toothbrushes during manufacture. It is further noted that a cutter for dental floss may be provided on the plastic holder 10 per se, so that the dental floss container 60 need not be removed from the holder. If desired the mounts may be formed of colored rather than transparent plastic. Accordingly, it is to be understood that the present invention is not limited to the precise construction as shown in the drawings and described hereinabove.

We claim:

1. A hygienic toothbrush mounting system comprising:

a main mounting member formed of translucent plastic;

said mounting member including at least one recess for receiving a toothbrush, for restraining the toothbrush against lateral movement, and for positioning the toothbrush vertically;

said mounting member having a small high strength permanent magnet corresponding to each recess and secured into said mounting member with an outer surface of said permanent magnet substantially flush with the bottom of said recess, said magnet outer surface having a transverse extent less than about 5/16 inch;

a toothbrush having dimensions to fit into said recess and having a predetermined area facing said permanent magnet when said toothbrush is positioned laterally and vertically in said recess; and a thin sheet metal element of magnetic material secured to said toothbrush on said predetermined area, said sheet metal element having a transverse extent equal to or just slightly greater than the outer surface of said permanent magnet, said sheet metal element having a non-corrosive outer surface;

whereby the translucent configuration of said mounting member and the relatively small configuration of said permanent magnet and said sheet metal element permit easy visual inspection of said system to insure hygienic cleanliness thereof.

2. A hygienic toothbrush mounting system as defined in claim 1 wherein said mounting member is transparent.

3. A hygienic toothbrush mounting system as defined in claim 1 wherein said magnet is a rare earth magnet, and wherein said sheet metal element is a plated steel element less than twenty-thousandths of an inch thick.

4. A hygienic toothbrush holder as defined in claim 1 further including means for mounting the mounting member to a substantially flat surface.

5. A hygienic toothbrush holder as defined in claim 4 wherein the mounting means includes a layer of pressure sensitive adhesive.

6. A hygienic toothbrush holder as defined in claim 1 wherein said mounting member further includes a second recess dimensioned for receiving a package of dental floss and further wherein said second recess includes a corresponding small high strength permanent magnet secured within the mounting member, and further wherein the dental floss container has a small thin sheet metal element of magnetic material secured to the back surface of the container.

7. A hygienic holder for at least one toothbrush having a small piece of magnetic material secured to the toothbrush comprising:

a main mounting member formed of translucent material;

said mounting member having a small high strength permanent magnet secured into said member for attracting the magnetic material on the toothbrush to the member; and said mounting member having at least one set of vertical walls for restraining the toothbrush against lateral movement within the mounting member, and for positioning the toothbrush in relation to the permanent magnet on the mounting member;

whereby the translucent configuration of said mounting member and the relatively small configuration of said permanent magnet permit easy visual inspection of the holder to insure hygienic cleanliness thereof.

8. A hygienic toothbrush in accordance with claim 7 wherein the mounting member further includes a set of substantially lateral walls for restraining the toothbrush against vertical movement within the mounting member and for positioning the toothbrush on the mounting member.

9. A hygienic toothbrush holder in accordance with claim 7 wherein said permanent magnet is a rare earth magnet.

10. A hygienic toothbrush holder in accordance with claim 7 further including means for securing the mounting member to a substantially flat surface.

11. A hygienic toothbrush holder in accordance with claim 10 wherein the securing means is comprised of at least one suction cup.

12. A hygienic toothbrush holder in accordance with claim 10 wherein the securing means is comprised of pressure-sensitive adhesive tape.

13. A hygienic toothbrush holder in accordance with claim 7 wherein the mounting member further includes means for magnetically securing a package of dental floss to the mounting member.

14. A hygienic holder for at least one toothbrush having a small piece of magnetic material secured to the toothbrush comprising:

a main mounting member;

said mounting member including at least one recess for receiving the toothbrush, for restraining the toothbrush against lateral movement, and for positioning the toothbrush vertically;

said mounting member having a small high strength permanent magnet corresponding to said recess and secured into said member with an outer surface of said magnet substantially flush with the bottom of said recess; and said main mounting member being formed of translucent plastic.

15. A hygienic holder for at least one toothbrush having a small piece of magnetic material secured to the toothbrush comprising:

a main mounting member;

said mounting member including at least one recess for recess for receiving the toothbrush, for restraining the toothbrush against lateral movement, and for positioning the toothbrush vertically;

said mounting member having a small high strength permanent magnet corresponding to said recess and secured into said member with an outer surface of said magnet substantially flush with the bottom of said recess; and said mounting member being formed of a transparent material.

16. A hygienic holder for at least one toothbrush having a small piece of magnetic material secured to the toothbrush comprising:

a main mounting member;

said mounting member including at least one recess for receiving the toothbrush, for restraining the toothbrush against lateral movement, and for positioning the toothbrush vertically;

said mounting member including at least one recess for receiving the toothbrush, for restraining the toothbrush against lateral movement, and for positioning the toothbrush vertically;

said mounting member having a small high strength permanent magnet corresponding to said recess and secured into said member with an outer surface of said magnet substantially flush with the bottom of said recess; and said permanent magnet is a rare earth magnet.

17. A hygienic toothbrush holder in accordance with claim 14 wherein said mounting member further includes means for securing the mounting member to a substantially flat surface.

18. A hygienic holder for at least one toothbrush having a small piece of magnetic material secured to the toothbrush comprising:

a main mounting member;

said mounting member including at least one recess for receiving the toothbrush, for restraining the toothbrush against lateral movement, and for positioning the toothbrush vertically;

said mounting member having a small high strength permanent magnet corresponding to said recess and secured into said member with an outer surface of said magnet substantially flush with the bottom of said recess;

said mounting member further includes means for securing the mounting member to a substantially flat surface; and the securing means comprising at least one suction cup.

19. A hygienic holder for at least one toothbrush having a small piece of magnetic material secured to the toothbrush comprising:

a main mounting member;

said mounting member including at least one recess for receiving the toothbrush, for restraining the toothbrush against lateral movement, and for positioning the toothbrush vertically;

said mounting member having a small high strength permanent magnet corresponding to said recess and secured into said member with an outer surface of said magnet substantially flush with the bottom of said recess; and further including at least one recess dimensioned for receiving a package of dental floss and further wherein said recess for receiving a package of dental floss includes a corresponding small high strength permanent magnet secured within the mounting member.

* * * * *